United States Patent [19]

Finlay

[11] 4,245,612

[45] Jan. 20, 1981

[54] ARCHERY BOW STABILIZER

[75] Inventor: Robert L. Finlay, Emporia, Kans.

[73] Assignee: BPE, Inc., Emporia, Kans.

[21] Appl. No.: 78,555

[22] Filed: Sep. 24, 1979

[51] Int. Cl.[3] ..... F41B 5/00

[52] U.S. Cl. ..... 124/89

[58] Field of Search ..... 124/89, 24 R, 23 R, 124/88, 41 A

[56] References Cited

U.S. PATENT DOCUMENTS

| | | | |
|---|---|---|---|
| 3,412,725 | 11/1968 | Hoyt | 124/89 X |
| 3,524,441 | 8/1970 | Jeffery | 124/89 X |
| 3,628,520 | 12/1971 | Izuta | 124/89 |
| 3,670,712 | 6/1972 | Izuta | 124/24 R X |
| 3,683,883 | 8/1972 | Izuta | 124/89 |
| 4,135,486 | 1/1979 | Enomoto | 124/89 |

*Primary Examiner*—William R. Browne

*Attorney, Agent, or Firm*—Schmidt, Johnson, Hovey & Williams

[57] ABSTRACT

A stabilizer for archery bows in the form of a hollow body, there being a rod for attaching the body to an archery bow, to position the body forwardly of the bow whereby the body may resist the torque of the bow when an arrow is released; absorb the shock and vibration occurring when the arrow is released and balance the bow. The stabilizer is particularly intended for use with hunting bows, there being scent emitting material carried within the body, the scent emanating therefrom passing through a plurality of holes which circumscribe the body and into the atmosphere whereby to cover any human scent and attract game. The weight of the stabilizer is adjusted by means of movable weights which are carried within the body and retained in position by a coil spring, there being a closure cap for the hollow body for gaining access to the interior thereof to permit positioning of the movable weights within the body, at the selection of the user of the stabilizer.

10 Claims, 6 Drawing Figures

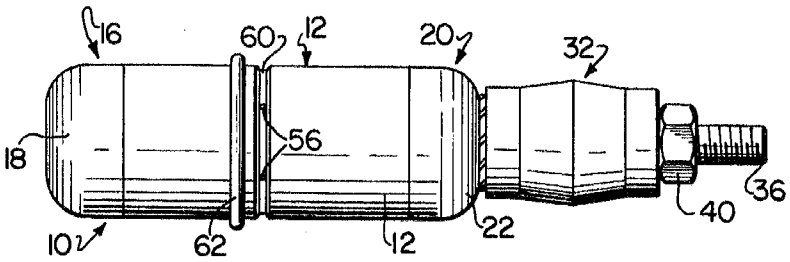
FIG. 1
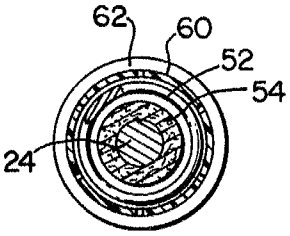
FIG. 5
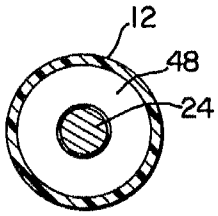
FIG. 6
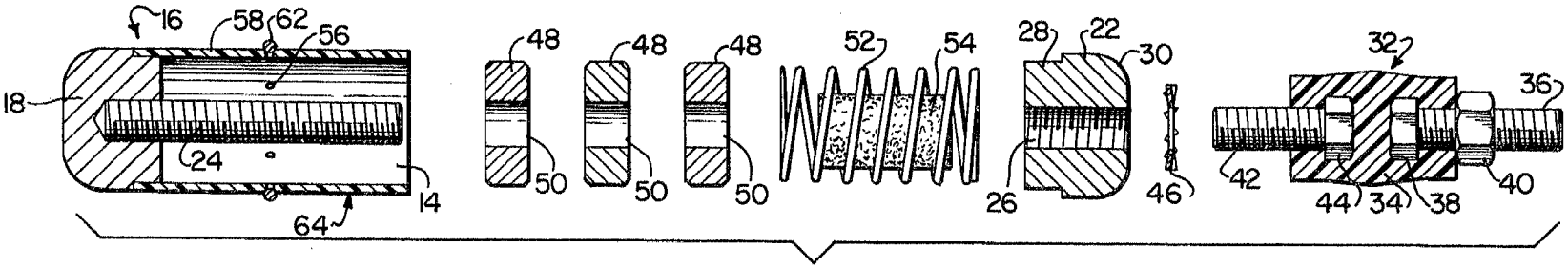
FIG. 2
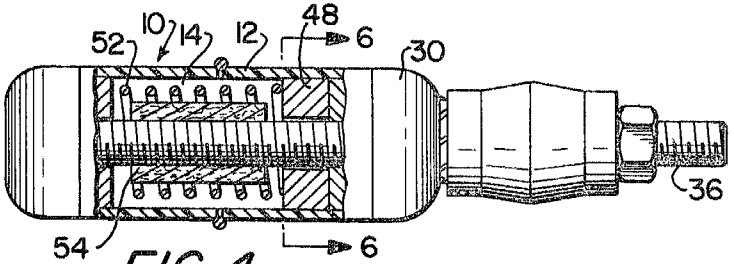
FIG. 4
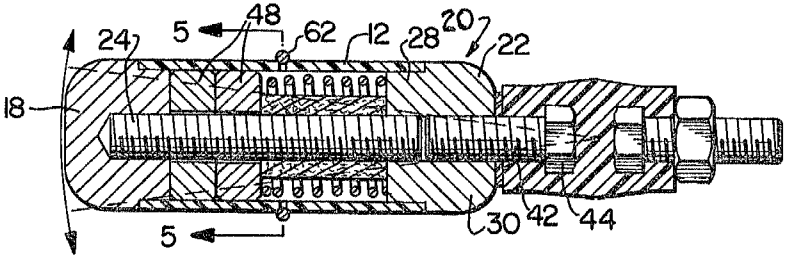

ARCHERY BOW STABILIZER

TECHNICAL FIELD

This invention relates to stabilizers for archery bows, which bows may be used for hunting or target shooting, the stabilizer having selectively variable weights carried thereby and, for use when hunting, scent emitting means which are carried interiorly of the stabilizer and selectively release a scent to attract game.

BACKGROUND ART

It has been known to utilize stabilizing assemblies in connection with archery bows, such assemblies normally being attached to the bow and extending forwardly therefrom whereby to resist the torque which is imparted to the bow when an arrow is released. The stabilizer also absorbs the shock and vibration occurring when the arrow is released from the bow.

Prior forms of stabilizers are exemplified by U.S. Pat. No. 3,196,860; U.S. Pat. No. 3,412,725; and U.S. Pat. No. 3,524,441.

A particular purpose of such stabilizers is to permit the user of the archery bow to carefully adjust the weight of the stabilizer whereby the bow may be "fine tuned" to particularly compensate for the arrow launching characteristics thereof and specifically adapt the bow to the user thereof so that greater accuracy may be obtained either in target shooting or in hunting.

Thus, adjustable weighting characteristics are desirable so that the overall weight of the stabilizer may be precisely determined, according to the characteristics of the bow, arrows which are used and the person utilizing the bow.

SUMMARY OF PRESENT INVENTION

It is the primary purpose of this invention to provide a stabilizer for archery bows, which stabilizer is particularly intended for use with hunting bows. To this end the stabilizer comprises a hollow body and flexible coupling means for attaching the body to the archery bow, there being scent emitting means carried within the body of the stabilizer, the scent emanating therefrom passing through a plurality of holes in the stabilizer body to the atmosphere whereby to attract game to the vicinity of the hunter utilizing the bow with the stabilizer thereon.

Another important object of the invention is to provide a stabilizer for archery bows and wherein the overall weight of the stabilizer may be precisely adjusted, either for hunting purposes or for the purpose of target shooting.

To this end the hollow body of the stabilizer receives a plurality of weights, which may be of differing sizes, the weights being selectively positionable within the body of the stabilizer whereby to concentrate the weight at either end of the stabilizer or distribute it equally at both ends so that the desired performance may be obtained. Means, in the form of a coil spring, are provided for retaining the weights at their selected, desired positions within the hollow body of the stabilizer.

Thus, the stabilizer hereinafter disclosed in detail, may be used for hunting purposes and, if so, the scent emitting means could be positioned within the hollow body of the stabilizer and the weights therein adjusted for game shooting. On the other hand, the same stabilizer could be utilized, with a rigid shaft for connecting the stabilizer body to the bow, and the scent emitting means eliminated but the weights being retained within the hollow body of the stabilizer and adjusted to "fine tune" the archery bow for target shooting purposes.

Other objects inlcude details of construction which will become apparent from the following description.

BRIEF DESCRIPTION OF THE DRAWINGS

FIG. 1 is a side elevational view of the archery bow stabilizer chosen for purposes of illustration;

FIG. 2 is an exploded sectional view showing the components of the stabilizer illustrated in FIG. 1;

FIG. 3 is a central sectional view of the stabilizer showing the same in an assembled condition, ready for use, with the movable weights being concentrated at the normally forwardmost end of the stabilizer;

FIG. 4 is a side elevational, partially sectional view of the stabilizer in its assembled condition and showing the weight concentrated at the normally rearmost end of the stabilizer;

FIG. 5 is a sectional view taken on line 5—5 of FIG. 3; and

FIG. 6 is a sectional view taken on line 6—6 of FIG. 4.

DETAILED DESCRIPTION

The archery bow stabilizer chosen for illustration is broadly designated by the numeral 10 and is particularly intended to be attached to an archery bow (not shown) used for hunting purposes.

The stabilizer 10 is in the form of a relatively elongated hollow body 12, the body 12 being cylindrical in configuration in the embodiment chosen for illustration. Hollow body 12 presents a central cavity 14, the cavity 14 being permanently closed at one end 16 thereof as by a closure plug 18, the end 16 of the body 12 being that end which is normally spaced from the archery bow to which the stabilizer 10 is attached.

The other end 20 of the body 12 is closed, when the stabilizer 10 is in use, by a removable closure cap 22.

A threaded rod 24 is carried by closure plug 18 and extends longitudinally centrally of the cavity 14 of hollow body 12. As best illustrated in FIG. 3 of the drawing, the closure cap 22 is provided with a threaded bore 26, which bore 26 extends entirely through the closure cap 22, spanning both a reduced portion 28 thereof and an enlarged portion 30. The reduced portion 28 of closure cap 22 is received within the cavity 14 of hollow body 12 whereby to close said other end 20 of the hollow body when the stabilizer is in use, the threaded rod 24 being received within the bore 26 provided in the closure cap 22.

Means 32 in the nature of a flexible coupling are provided for attaching the body 12 to an archery bow, normally at a suitable location on the bow so that the stabilizer extends forwardly from the bow. The flexible coupling 32 is particularly intended for use with a stabilizer such as 10 which is intended for attachment to hunting bows whereby to permit movement of the stabilizer 10 when an arrow is discharged from the bow, the stabilizer swinging in the direction of the arrows on FIG. 3 of the drawing, all to the end that the torque normally imparted to the bow when the arrow is released is resisted and also shock and vibration created by the firing of the arrow are dampened by the stabilizer.

Flexible coupling 32 is more specifically in the form of a bushing 34 of resilient material such as rubber, the bushing 34 having a threaded shaft 36 extending therefrom and in the direction of the bow, the shaft 36 having a head 38, there being a nut 40 threaded on the shaft 36. Extending in the opposite direction from the resilient bushing 34 is a threaded stud 42 having a head 44 which is embedded in the resilient bushing 34, it being noted that head 44 is spaced from head 38 whereby to permit greater flexing of the coupling 32 when an arrow is discharged from the bow.

In order to attach the coupling 32 to the hollow body 12, the threaded stud 42 is received within bore 26 of closure cap 22, there being a lock washer 46 interposed between bushing 34 and cap 22 when the stabilizer is assembled and as is illustrated in FIGS. 1, 3 and 4 of the drawing. Thus, the bore 26 which is provided in closure cap 22 receives not only one end of the threaded rod 24 when the cap is in place upon the body but also receives therewithin, in threaded relationship, the stud 42 whereby to assemble the stabilizer into a condition ready for use.

To attach the stabilizer 10 to a bow, the shaft 36 is threaded into a fitting which is carried by the bow at the desired location and nut 40 is tightened to securely affix the stabilizer 10 to the archery bow.

The cavity 14 of hollow body 12 selectively receives one or more weights such as 48, the weights being annular in configuration and each having a central aperture 50, whereby the weights may be moved along the threaded rod 24 into the desired position within the cavity 14 of body 12. It will be readily appreciated that the weights may be larger or smaller than those depicted and if desired, for instance, could be in the form of a washer, so long as the diameter of the washer was such as to permit it to fit within the confines of the cavity 14. It is desired that the weights 48 be of essentially the same diameter as the interior diameter of cavity 14 so that they will fit snugly therewithin, as illustrated, and also be retained by virtue of their circumscribing relationship to the threaded rod 24 which extends centrally of the cavity 14.

In order to retain weights such as 48 in their desired and selected location within the cavity 14, there is provided a compression coil spring 52 which likewise is of an outside diameter essentially the same as the inside diameter of the cavity 14 whereby the spring 52 may be snugly received within the cavity 14. Note that spring 52 also is positioned within cavity 14 in surrounding relationship to the threaded rod 24.

When the stabilizer 10 is to be used for hunting purposes particularly, there is provided a scent impregnated pad 54 which is carried within the confines of spring 52, as illustrated, and is positioned within the cavity 14 of hollow body 12 when the stabilizer is in use. The pad 54 may be impregnated with any desired scent and particularly one which is intended to attract game of the type being hunted by the user of the archery bow. The scent impregnated into the pad 54 not only covers any human scent emanating from the user of the bow but also serves as an attractant to game animals. Further, it is extremely convenient to have the scent emitting means as a part of the stabilizer, this eliminating the necessity of the hunter carrying the scent within a separate receptacle or placing the scent upon his body which is difficult to remove once hunting has been completed. Any number of desired scents may be selectively impregnated into the pad, the particular scent to be utilized depending upon the game being hunted.

In order to permit the scent which emanates from the pad 54 to reach the atmosphere and thus achieve its intended purpose, the hollow body 12 is provided with a plurality of holes such as 56, which circumscribe the body 12 in spaced relationship thereabout, as illustrated for instance in FIGS. 1 and 2 of the drawing. The holes 56 each extend through the wall 58 of the body 12 and thus place the interior of the body into communication with the atmosphere.

A groove 60 is formed in the exterior surface of wall 58 of body 12 and the holes 56 are formed in the bottom of the groove 60, as illustrated.

In order to permit selective closing of the holes 56, there is provided a resilient member 62, in the nature of an O-ring, which member 62 surrounds the exterior of hollow body 12 and is manually movable into a position seated within the groove 60 or, in the alternative, spaced therefrom. In the drawings, FIG. 1 shows the resilient member 62 moved out of the groove 60, thereby permitting the scent emitted from pad 54 to pass through the holes 56 and to the atmosphere. However, when it is desired to discontinue the emanation of the scent, the resilient ring 62 is merely rolled along the exterior body 12 until it seats within the groove 60, thus closing the holes 56 and confining the scent to the interior of the hollow body 12. It is particularly notable that the ring 62 may be readily rolled along the exterior of the body 12, even by a hunter who has cold hands or is wearing gloves. Thus, the scent may be readily turned on and off, depending upon the placement of resilient member 62 with respect to groove 60 and thus holes 56.

In order to adjust the overall weight of the stabilizer and to "fine tune" the same to the particular user of the bow to which the stabilizer is attached, the head portion of the stabilizer; that is, the portion normally extending beyond closure cap 22 and designated as 64, may be unscrewed from the closure cap 22 even while the stabilizer is attached to the bow. When this is done, access is gained to the cavity 14 and the weights such as 48 may be removed therefrom. the weights may then be positioned as desired by the user of the bow. For instance, FIG. 3 of the drawing illustrates the weights then being used as concentrated at the one end 16 of the hollow body 12 of the stabilizer. With the weights so positioned, they are retained in said position by placing the spring 52 within the cavity 14 and then closing the other end 20 of the hollow body 12 as by screwing the closure cap 22 onto the threaded rod 24.

On the other hand, if it is desired to place either one or more of the weights at the inner end 20 of the hollow body, the spring 52 would be first inserted within cavity 14 and then a weight would be inserted over threaded rod 24, as illustrated for instance in FIG. 4 of the drawing. Thence, by screwing the closure cap onto the rod 24, the weight would be retained in the position illustrated by virtue of the engagement of the weight by retaining spring 52, the other end of the spring bearing against closure plug 18.

It will be readily appreciated that the weights may be selectively positioned by the user of the stabilizer at either end of the cavity 14 and either one or more weights may be used, the same being securely retained in position by the presence of spring 52.

When the stabilizer is used for target shooting purposes, it will be preferable to couple the same to the bow by an elongated, rigid shaft, rather than by flexible coupling 32, although the weights would still be movable and selectively positionable as disclosed above. It is an important feature to have the weights enclosed within the hollow body 12 so that when the archery bow is "fine tuned" by the user thereof, the particular arrangement of weights will not be visible to competitors inasmuch as the weighting arrangement is wholly confined within the hollow body 12.

When it is desired to utilize the stabilizer for hunting purposes, a flexible coupling such as 32 would be used to connect the stabilizer to the bow and desirably, the scent pad 54 would be impregnated with the desired scent and inserted within the cavity 14 of the hollow body 12 prior to hunting. Once a hunting station has been reached, the resilient ring 62 can be rolled out of its position seated within groove 60 and the scent will then be emitted to the atmosphere through holes 56 to hopefully attract game to the proximity of the user of the stabilizer.

Having thus described the invention, what is claimed as new and desired to be secured by Letters Patent is:

1. An archery bow stabilizer comprising:

a hollow body;

means for attaching the body to an archery bow;

a plurality of holes circumscribing the body; and placing the interior of the hollow body in communication with the atmosphere; and scent emitting means carried within the body, the scent emanating therefrom passing through said holes to the atmosphere.

2. An archery bow stabilizer as set forth in claim 1, there being means for selectively closing said holes to prevent the scent from passing through said holes to the atmosphere.

3. An archery bow stabilizer as set forth in claim 2, said means being in the form of a resilient member surrounding the exterior of said body and shiftable into and out of overlying engagement with said holes.

4. An archery bow stabilizer as set forth in claim 3, said holes lying within a groove formed in the exterior of said body.

5. An archery bow stabilizer as set forth in claim 4, said resilient member being received within said groove when it is in overlying engagement with said holes.

6. An archery bow stabilizer as set forth in claim 5, said scent emitting means being in the form of an absorbent pad selectively positionable within said hollow body.

7. An archery bow stabilizer comprising:

a hollow body;

means for attaching the body to an archery bow;

a plurality of removable weights carried within the body; for varying the weight of the stabilizer and means for retaining said weights in selected positions within said body, there being a threaded rod extending longitudinally centrally of the hollow body, each said weights encircling said rod.

8. An archery bow stabilizer as set forth in claim 7, said means for retaining the weights in cluding a spring within said hollow body and bearing against said weights.

9. An archery bow stabilizer as set forth in claim 7, said hollow body having a closure cap at one end thereof for gaining access to the interior of the body to permit positioning of the movable weights within the body.

10. An archery bow stabilizer as set forth in claim 9, said means for attaching the body to an archery bow including a flexible coupling member interposed between said cap and a bow whereby to permit movement of the body.

* * * * *